US011168452B2

(12) United States Patent
Ward

(10) Patent No.: US 11,168,452 B2
(45) Date of Patent: Nov. 9, 2021

(54) FLOOD BARRIER

(71) Applicant: Einstein IP Limited, Tonbridge (GB)

(72) Inventor: Nicholas Ward, Hampshire (GB)

(73) Assignee: Einstein IP Limited, Kent (GB)

( * ) Notice: Subject to any disclaimer, the term of this patent is extended or adjusted under 35 U.S.C. 154(b) by 480 days.

(21) Appl. No.: 16/317,932

(22) PCT Filed: Jul. 17, 2017

(86) PCT No.: PCT/GB2017/052099
§ 371 (c)(1),
(2) Date: Jan. 15, 2019

(87) PCT Pub. No.: WO2018/011605
PCT Pub. Date: Jan. 18, 2018

(65) Prior Publication Data

US 2021/0285175 A1 Sep. 16, 2021

(30) Foreign Application Priority Data

Jul. 15, 2016 (GB) ..... 1612363

(51) Int. Cl.
*E02B 3/10* (2006.01)
*E02B 3/16* (2006.01)

(52) U.S. Cl.
CPC ..... *E02B 3/106* (2013.01); *E02B 3/16* (2013.01)

(58) Field of Classification Search
CPC ..... E02B 3/106; E02B 3/16
(Continued)

(56) References Cited

U.S. PATENT DOCUMENTS 830,437 A * 9/1906 Humphrey ..... E02B 3/106 405/113
2,867,160 A 1/1959 Wangerow
(Continued)

FOREIGN PATENT DOCUMENTS

CA 2451212 A1 * 1/2003 ..... E02B 3/106
DE 20016969 5/2001
(Continued)

OTHER PUBLICATIONS

International Search Report dated Sep. 21, 2017 in parent PCT application PCT/GB2017/052099.
(Continued)

*Primary Examiner* — Tara Mayo-Pinnock
(74) *Attorney, Agent, or Firm* — Andrus Intellectual Property Law, LLP

(57) ABSTRACT

A flood barrier to protect an area of land from floodwaters, the flood barrier having a waterside to be placed adjacent a body of water and a protected side opposing the waterside, the flood barrier comprising a plurality of supports spaced apart from one another; at least one intermediate barrier section supported to extend between a pair of neighbouring supports when assembled, the intermediate barrier section comprising at least a first beam arrangeable such that it is supported to extend between the corresponding pair of neighbouring supports and a water impermeable membrane sheet attachable to said first beam via a mechanical connection to form a skirt extending from said first beam, outwardly from the waterside of the flood barrier onto the ground.

18 Claims, 6 Drawing Sheets

(58) Field of Classification Search
USPC ..... 405/107, 110, 112, 114
See application file for complete search history.

(56) References Cited

U.S. PATENT DOCUMENTS

| | | | | |
|---|---|---|---|---|
| 6,443,655 | B1 * | 9/2002 | Bennett | E02B 3/106 256/13 |
| 6,840,711 | B1 * | 1/2005 | Martinez etal. | E02B 3/106 405/107 |
| 2003/0156903 | A1 * | 8/2003 | Wiseman etal. | E02B 3/106 405/115 |
| 2015/0204040 | A1 * | 7/2015 | Knezevich et al. | E02B 3/102 405/114 |
| 2016/0289908 | A1 * | 10/2016 | Krogenes | E02B 3/106 |

FOREIGN PATENT DOCUMENTS

| | | | | |
|---|---|---|---|---|
| DE | 102004054976 | | 5/2006 | |
| DE | 102005002485 | | 8/2006 | |
| DE | 102008013078 | | 9/2009 | |
| EP | 1262602 | | 12/2002 | |
| EP | 1262602 | A2 * | 12/2002 | E02B 3/106 |
| EP | 1728928 | | 12/2006 | |
| EP | 2299004 | | 3/2011 | |
| FR | 2876716 | A1 * | 4/2006 | E02B 3/106 |
| GB | 2427641 | | 3/2007 | |
| KR | 100919275 | | 9/2009 | |
| WO | WO-0181681 | A1 * | 11/2001 | E02B 3/106 |
| WO | 2010130406 | | 11/2010 | |
| WO | WO 2010/130406 | A1 * | 11/2010 | E02B 3/106 |
| WO | 2013067571 | | 5/2013 | |
| WO | 2014175840 | | 10/2014 | |

OTHER PUBLICATIONS

Great Britain search report dated Jan. 10, 2018 in priority GB application 1711473.7.

* cited by examiner

FLOOD BARRIER

CROSS REFERENCE TO RELATED APPLICATIONS

The present application is the U.S. national stage application of International Application PCT/GB2017/052099, filed Jul. 17, 2017, which international application was published on Jan. 18, 2018 as International Publication 2018/011605 A1. The International Application claims priority to Great Britain Application 1612363.0 filed Jul. 15, 2016.

FIELD OF THE INVENTION

The present invention relates to a flood barrier and in particular a portable flood barrier. The invention also relates to kits for flood barriers and methods for erecting such flood barriers.

BACKGROUND TO THE INVENTION

Portable flood barriers come in a number of forms each with its own set of relative advantages and disadvantages. Tubes and flexible membranes are known for use in portable flood barriers but have limited life and demonstrate vulnerability to floating debris, high flow currents and waves. Membranes may be prone to sliding if anchoring is not undertaken, tubes may be vulnerable to sliding, rolling and collapse.

In contrast portable flood barriers of metal may be more resistant and offer a degree of self-anchoring due to the inclination of the supporting stanchions, usually at 45 degrees. A disadvantage with these type of barriers is that they are generally reliant on a membrane to be draped over the system. This means that they are not sufficiently watertight until the entire system is erected and covered by the membrane. This significantly impacts their effectiveness as deployment time renders their application inappropriate due to lack of manpower or available warning time.

The use of a membrane is also a problem in its extension of the required footprint with no resultant increase in stability. These systems remain prone to sliding especially on surfaces such as wet concrete or asphalt. This is because hydrostatic pressure applied onto this sheet will act on the ground where it is transferred down, and onto the face of the barrier where it will increase the sliding potential. The result is a separation of the barrier structure from the membrane.

These problems can be overcome by anchoring the stanchions, however this is resisted by many highways authorities and municipalities, or by loading with weight such as sandbags, however this increases the deployment time for the system and requires further manpower.

Another major problem with metal flood barriers is the requirement of operatives to carry out operations on the flood-side of the barrier. This is caused by the requirement for the barrier to be fully erected before the membrane can be unfurled, draped and secured at the top edge of the barrier. In instances of deployment in rising water, this causes a significant problem in getting the membrane into position on the ground with anchor chains or sandbags on top. This can produce a significant health and safety risk and one which is exacerbated by isolation of the flood-side of a barrier extending perhaps many hundreds of metres. For this reason, it is good practice for operatives deploying such barriers to wear wet gear including life-jacket and hardhat To provide a stronger barrier and to remove this risk of isolation, superior products have reverted to aluminium stop logs or cross-breams to seal in between the stanchions reflecting the historic use of timber stop logs.

The beams require compression vertically to the ground or to the beam below in order to seal along the horizontal joints. This downward pressure is typically exerted by complicated components which provide adjustable tension along the vertical plane.

The bottom beam also requires horizontal compression to ensure a good seal as floodwater rises and to ensure that the beam is not easily displaced. Current systems have U-channels in the sides of the stanchions in which the beams are slotted. However, there is a great deal of friction as the beam is slid against a vertical gasket, making the beams hard to install. This U-channel is typically only to the height of the bottom beam on a portable inclined barrier however the mobility of the stanchions and the frictions and tight tolerances against the vertical gasket make this operation problematic. Removal of the beam during disassembly is even more difficult than installation of the beam.

Despite the use of soft thick gaskets on the bottom beam they fail to adequately seal on uneven ground. The use of a membrane draped over the system would solve this but present the same disadvantages which are inherent in the panel systems.

SUMMARY OF INVENTION

According to a first aspect of the invention there is provided a flood barrier to protect an area of land from floodwaters, the flood barrier having a waterside to be placed adjacent a body of water and a protected side opposing the waterside, the flood barrier comprising a plurality of supports spaced apart from one another; at least one intermediate barrier section arrangeable to be supported to extend between a pair of neighbouring supports, the intermediate barrier section comprising at least a first beam arrangeable such that it is supported to extend between the corresponding pair of neighbouring supports and a water impermeable membrane sheet attachable to said first beam via a mechanical connection to form a skirt extending from said first beam, outwardly from the waterside of the flood barrier onto the ground.

The skirt allows sealing against uneven ground by the hydrostatic load imparted onto the ground by floodwater. The mechanically connected membrane sheet is integral with the first beam once connected. The mechanical connection ensures the skirt and structural elements of the barrier act as one and in doing so reduce the risk of sliding of the membrane sheet. The present invention is stable through reduced sliding risk, the elements allow rapid deployment from the protected side of the barrier, therefore it is more efficient and safer than prior art systems.

Suitably the flood barrier comprises connection means which forms the mechanical connection of the membrane to the first beam. Preferably the first beam comprises a connecting portion and the membrane comprises a connecting portion attachable to the connecting portion of the first beam. The connection means preferably consists essentially of the connecting portion of the first beam and the connecting portion of the membrane. In other words the flood barrier is configured such that the membrane sheet is attachable to the first beam without requiring any additional fixings. Preferably the connecting portion of the first beam comprises an elongate slot disposed at or near the bottom side of the first beam. Preferably the connecting portion of the membrane comprises an expanded tubular edge arranged longitudinally along the top edge of the membrane sheet. The expanded tubular edge is arranged such that the expanded tubular edge is receivable in the elongate slot.

Preferably the mechanical connection of the membrane to the first beam is a non-compressing connection. In other words, the connection between the membrane and the first beam is formed without any means compressing the membrane and the beam together to form the connection.

Preferably said first beam of the or each intermediate barrier section has first and second ends and first and second elongate sides, and wherein each support in each pair of neighbouring supports includes a retaining plate for fastening an end of said corresponding first beam to the support, each retaining plate having a fastening configuration, in which said beam end is compressed between the retaining plate and the corresponding support, and a release configuration, in which the beam may be inserted/withdrawn from between the retaining plate and the corresponding support.

Preferably each retaining plate is hingedly connected to the corresponding support.

Preferably each retaining plate includes compressible securing means for compressibly securing the end of a beam to the corresponding support.

Preferably said compressible securing means is a locking pin.

Preferably said first beam has first and second ends and top and bottom elongate sides, the mechanical connection of the membrane to the first beam comprising an elongate slot disposed at or near the bottom side of the first beam.

Preferably said first beam has first and second ends and top and bottom elongate sides, the mechanical connection of the membrane to the first beam comprising an expanded tubular edge arranged longitudinally along the top edge of the membrane sheet.

Preferably said first beam has first and second ends and top and bottom elongate sides, the mechanical connection of the membrane to the first beam comprising an elongate slot disposed at or near the bottom side of the first beam and an expanded tubular edge arranged longitudinally along the top edge of the membrane sheet, the elongate slot and expanded tubular edge being arranged such that the expanded tubular edge is receivable in the elongate slot.

Preferably the mechanical connection of the membrane to the first beam is via kader connection. Alternatively the mechanical connection of the membrane to the beam is via mechanical connection means such as bolts, rivets or screws.

Preferably each support comprises a first post and an elongate base, wherein the first post can be fixed at an incline relative to the base and wherein the at least one beam rests against the first post when assembled. With the first post being at an incline relative to the base, the beam or beams supported by the supports are also at an incline relative to the support bases.

Preferably each support further comprises a second post which can be fixed to the first post and the base. The first post, second post and base suitably form the three sides of a triangle.

Preferably the second post of each support is four sided hollow tubular post. Suitably the tubular post has a square cross-section i.e. it is a box beam Preferably each support has an open configuration, in which the first and second posts and the base are arranged to support said at least one beam, and a folded configuration, in which the first and second posts and the base are in a folded state relative to one another for ease of storage or transportation.

Preferably the elongate base of each support is U-shaped such that it can receive the second post therein when the support is in its folded configuration.

Preferably the underside of the first post of each support has a U-shaped configuration such that it can be received over the base when the support is in its folded configuration. The first post preferably has a double flange on its underside and a single, central flange on its upper side, such that the cross-section of the first post forms a cruciform type shape.

Preferably each membrane sheet, when attached, extends laterally beyond each end of the first beam to which it is attached to form first and second extension portions, whereby each extension portion can be retained between the corresponding retaining plate and support adjacent said extension portion.

Preferably the extension portions of each membrane extend such that each can overlap the extension portion of any neighbouring membrane, the overlapping extension portions being retained between the corresponding retaining plate and support adjacent said overlapping extension portions.

Preferably the intermediate barrier section comprises at least a second beam arrangeable such that it is supported to extend between the corresponding pair of neighbouring supports, the first and each further beam being stacked one above the other when assembled, to form a continuous barrier surface. Each intermediate barrier section preferably comprises a plurality of beams. In this case the membrane sheet is attached to the first beam of the plurality of beams of each intermediate barrier section, the first beam preferably being the bottom beam, closest to the ground.

Preferably the first beam of each intermediate barrier section to which the membrane sheet is attached is the beam which is closest to the ground when the flood barrier is erected.

Preferably the beams in each intermediate barrier section are configured to interlock with one another when assembled. In such embodiments the beams can interlock via suitable means such as tongue and groove joints. Each tongue and groove joint may include a sealing member to provide a seal between each adjacent beam.

Preferably the first beam of each intermediate section has a sealing member disposed on the elongate side of the beam that is to be arranged adjacent the ground such that a seal may form between the beam and the ground when the flood barrier is erected.

Preferably the flood barrier comprises a plurality of said intermediate barrier sections, the intermediate barrier sections being arrangeable side by side in a row such that each is supported to extend between a pair of neighbouring supports of said plurality of neighbouring supports, the supports and intermediate barrier sections forming a continuous barrier surface.

Preferably the skirt formed by the membrane extends outwardly from said first beam by at least a predetermined length that is sufficient such that hydrostatic forces acting upon the skirt will overcome sliding forces imparted on the flood barrier by floodwaters. The inventors have realised that by providing a skirt that is sufficiently long, it can not only provide a seal against the ground, but also to reduce the risk of sliding of the flood barrier due to the action of floodwaters on the barrier. The predetermined skirt length is preferably equal to or above the length at which the force from the mass of water acting on the skirt will overcome sliding forces on the flood barrier.

According to a further aspect of the invention there is provided a kit for assembly into a flood barrier according to any aspect of the invention as previously described, wherein the kit comprises the parts for said flood barrier.

According to a further aspect of the invention there is provided a method of installing a flood barrier, the method comprising providing a flood barrier according to any aspect of the invention as previously described, erecting a plurality of supports and placing an intermediate barrier section to extend across the space between each neighbouring pair of supports.

BRIEF DESCRIPTION OF THE DRAWINGS

A preferred embodiment of the present invention will now be more particularly described by way of example only with reference to the accompanying drawings, wherein.

DESCRIPTION OF THE PREFERRED EMBODIMENTS

Figure 1:
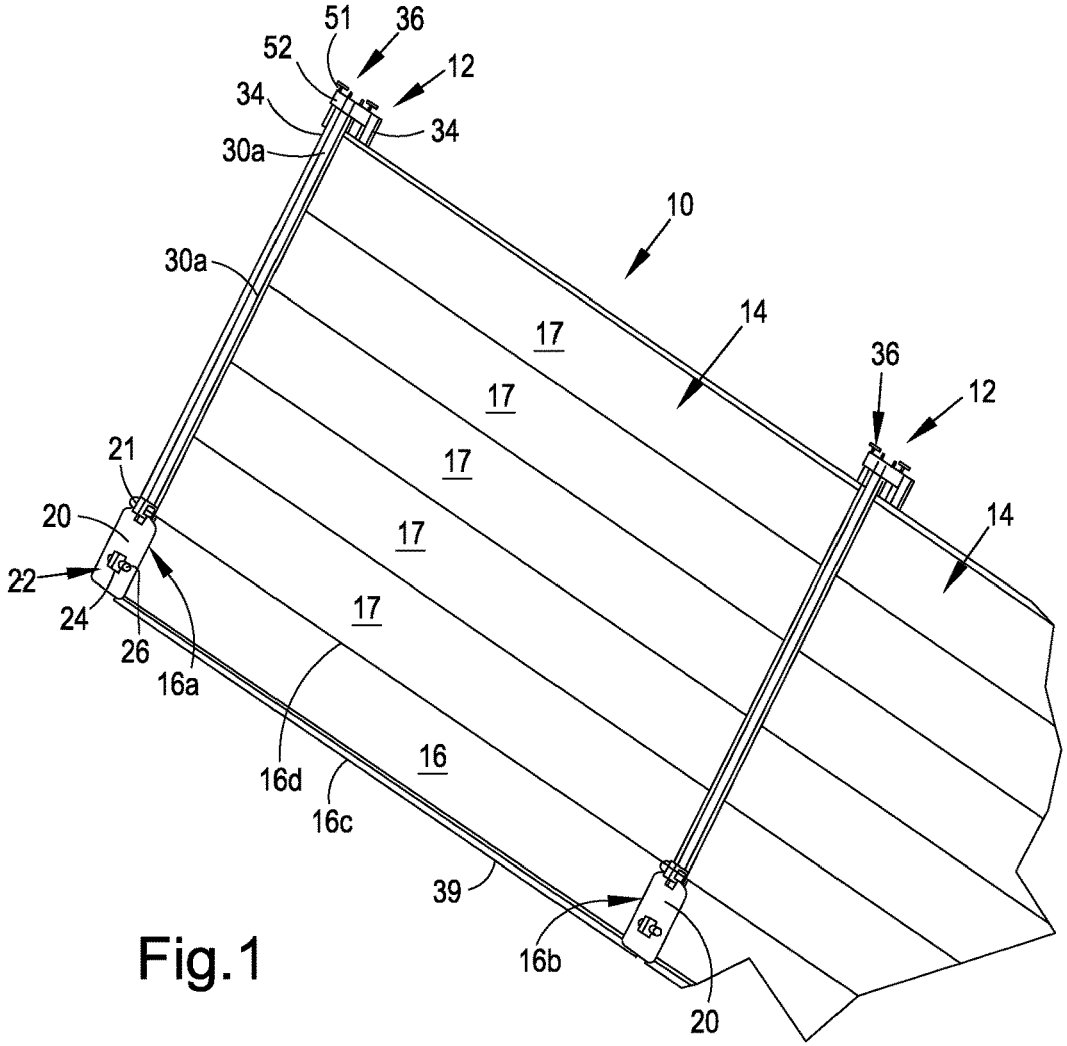
FIG. 1 is a perspective view of a flood barrier according to the present invention.

The present embodiments represent currently the best ways known to the applicant of putting the invention into practice. But they are not the only ways in which this can be achieved. They are illustrated, and they will now be described, by way of example only. Like reference numerals are used to refer to like components.

Referring to FIG. 1, an assembled flood barrier 10 is shown. Although an assembled flood barrier will be described, it will be understood that it can be provided as a kit such that it can be assembled/disassembled as required so that the barrier can function as a portable flood barrier. The flood barrier has a waterside to be placed adjacent a body of water and a protected side opposing the waterside. The flood barrier 10 has a plurality of stanchions or supports 12 and a plurality of intermediate barrier sections 14, one intermediate barrier section 14 disposed between each pair of neighbouring supports. In FIG. 1, two supports 12, one whole intermediate section 14 and part of an adjacent intermediate section 14 are shown, however it will be understood that a continuous barrier wall can be formed of multiple supports 12 and intermediate barrier sections 14 connected together.

Figure 6:
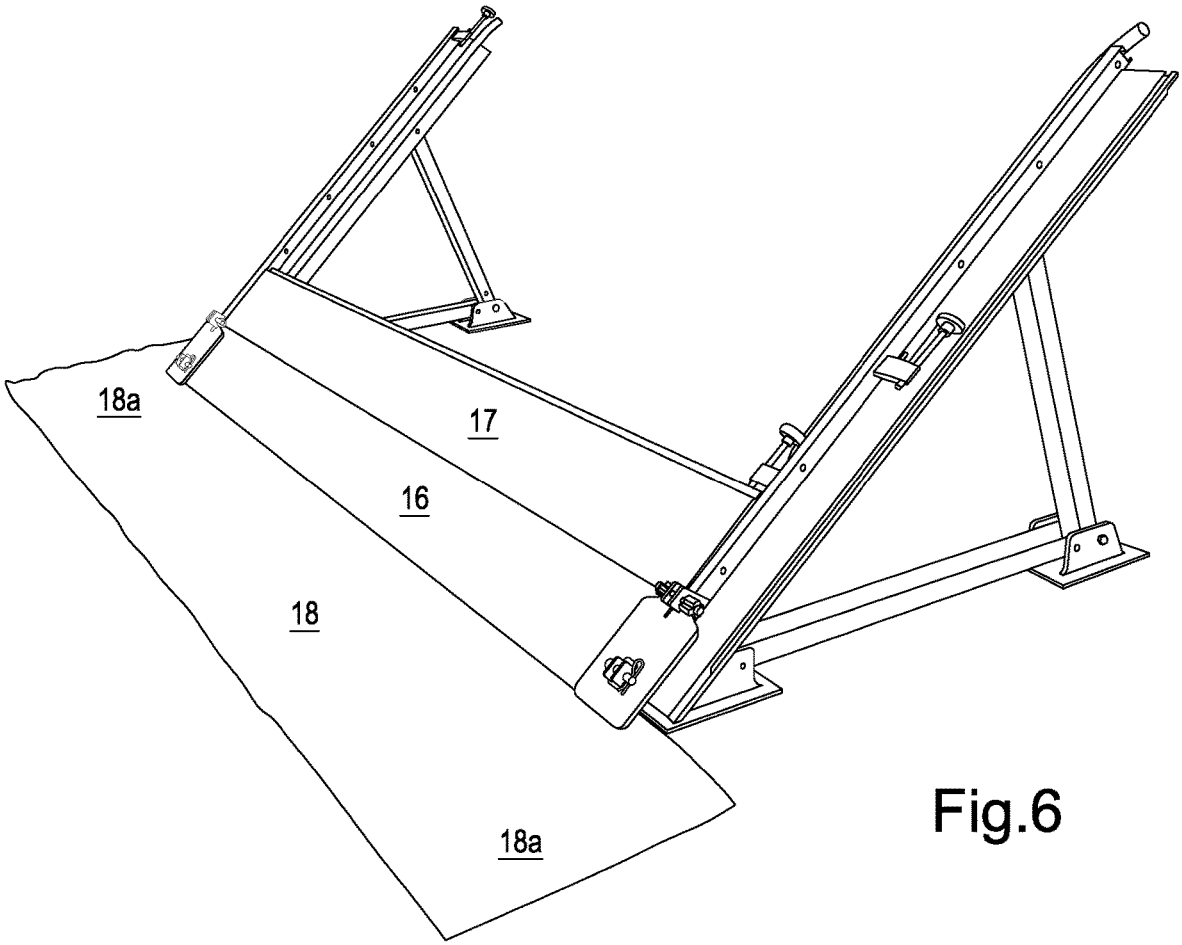
FIG. 6 is a perspective view of two supports with two beams installed therebetween and with a membrane sheet attached to the first beam.

A portion of the barrier formed by a pair of neighbouring supports 12 and an intermediate barrier section 14 will now be further described and it will be understood that further sections of the barrier will be alike. The intermediate barrier section 14 has a first beam 16 arranged between the pair of neighbouring supports 12. Referring to FIG. 6, the intermediate barrier section 14 also has a water impermeable membrane sheet 18 attached to the first beam 16 via a mechanical connection to form a skirt or apron extending, from the first beam 16, outwardly from the waterside of the flood barrier (the membrane sheet 18 is not shown in FIGS. 1 to 5).

Referring to FIG. 1, the intermediate barrier section 14 has a plurality of further beams 17 horizontally placed between the pair of neighbouring supports 12. The beams 16, 17 of the intermediate barrier section 14 are arranged stacked one above the other and are configured to interlock with one another, such as via tongue and groove joints, to form a continuous barrier between the leading edge and the trailing edge of the flood barrier. The join between each beam 16, 17 preferably includes a sealing member (not shown) to form a seal between adjacent beams. The beams 16, 17 may be any suitable crossbeam, panel or stop log. The beams 16, 17 may be made of metal or any other suitable material capable of resisting hydrostatic and/or hydrodynamic loads. The beams 16, 17 are designed to resist the hydrostatic and hydrodynamic loads likely to be imparted during a flood event. The beams can be put in place, one at a time, whilst the installer is standing on the protected side of the flood barrier. Instead of the intermediate barrier section comprising multiple beams stacked one above the other, it may simply comprise a single panel or beam to which a membrane sheet is mechanically attached, the single panel or beam being supported by a neighbouring pair of spaced apart supports. In that case, the first beam 16 would be the only panel of the intermediate barrier section.

In the intermediate barrier section 14 shown in the figures, the first beam 16 has first and second ends 16*a*, 16*b* and first and second elongate sides 16*c*, 16*d*. Each support 12 has a retaining plate 20 for fastening an end of a beam 16 between the retaining plate 20 and the support 12. In this embodiment each retaining plate 20 is a hinged pressure plate which is hingedly connected to the corresponding support 12 and has a fastening configuration in which said beam end 16*a*, 16*b* is compressed between the retaining plate 20 and the support 12 and a release configuration in which the beam 16 may be inserted/withdrawn from between the retaining plate 20 and the corresponding support 12. Each retaining plate 20 has a hinge 21 connecting it to the corresponding support 12. Each retaining plate 20 is secured in its fastening configuration in which it compresses the beam end 16*a*, 16*b* by a locking pin mechanism 22, although other means for compressibly securing the retaining plate 20 to the support 12 with a beam end therebetween could be provided. The locking pin mechanism 22 comprises an upstand 23 which is upstanding from the support 12 and passes through a hole 24 in the retaining plate 20. The upstand 23 has a transverse hole 25 for receiving a locking pin 26 therethrough.

Figure 2:
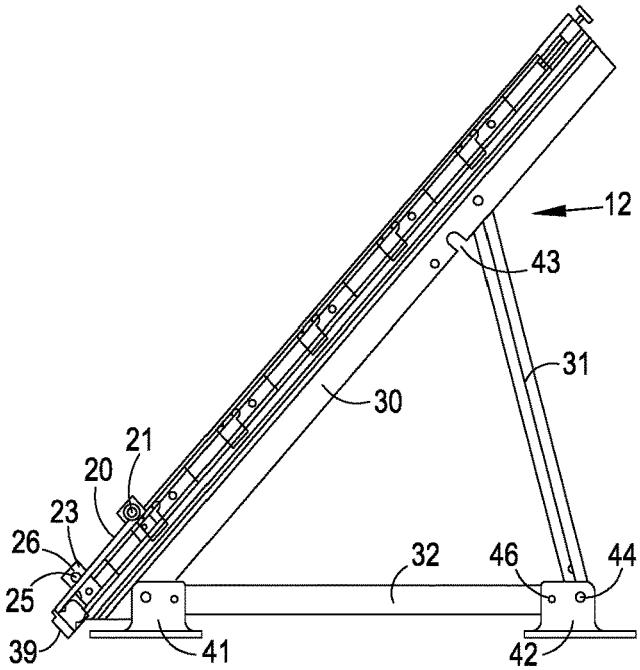
FIG. 2 is a section through the assembly of FIG. 1.

Referring to FIG. 2, each support 12 comprises a first post 30, a second post 31 and an elongate base 32 which are rigidly attachable to one another such that they form the sides of a triangular shaped support. The first post 30 is inclined relative to the base 32 such that the beams disposed on the supports 12 are also arranged at an incline relative to the base 32. The first post 30 is inclined such the angle between the first post 30 and the ground is preferably less than 90 degrees, and preferably around 45 degrees. The first post 30 of each support 12 has an upperside and an underside, the upperside having a single elongate flange 30*a* running along its axis, midway between the long sides of the post. Each of the first posts has a pair of elongate sealing members 34, such as gaskets, disposed on its upperside, one on either side of the flange 30*a*. When the beams 16, 17 are arranged to span between the corresponding neighbouring pair of supports 12, the beam ends rest on a sealing member 34. The retaining plate 20 compresses the first beam 16 against the sealing member 34, forming a tight seal. The beams 16, 17 are compressed against the ground in the direction of the plane of the beams 16, 17, in order to seal the horizontal joints between the beams, by a compression device 36 which will be described in more detail later. In the event of flooding, hydrostatic pressure applied to the panel formed by the beams 16, 17 will press the beams 17 against the sealing members 34, forming a seal between the beams 17 and the supports 12.

Figure 7:
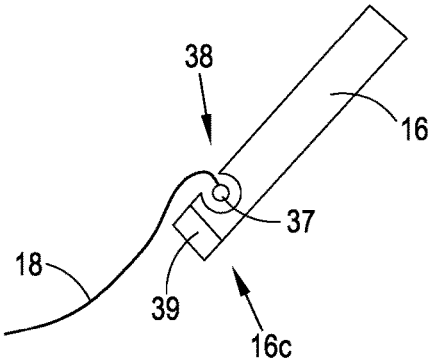
FIG. 7 is a section through the first beam of FIG. 6 showing the membrane sheet attached to the first beam.

In a preferred embodiment the mechanical connection of the membrane sheet 18 to the first beam 16 is via "kader" connection (also known as "keder" connection), in which a fabric with an expanded, tubular edge, typically called kader or keder is secured in a slot or channel via sliding. Referring to FIG. 7, the membrane sheet 18 has a longitudinal kader rod 37 arranged along the edge of the membrane sheet 18 to be attached to the first beam 16, the kader rod 37 being receivable in an elongate slot 38 disposed at or near the bottom side 16*c* of the first beam 16.

Figure 8:
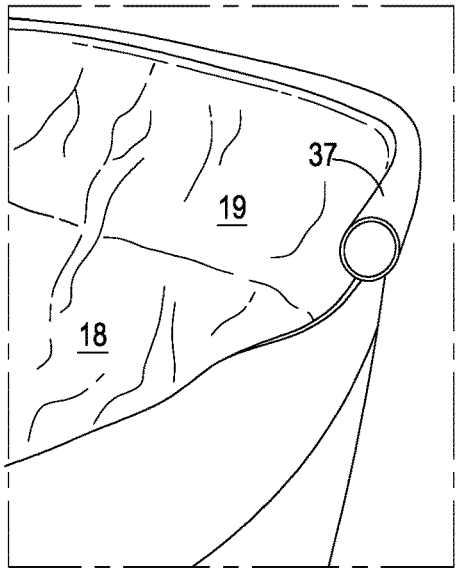
FIG. 8 is an end on view of the kader rod of the membrane sheet.
Figure 9:
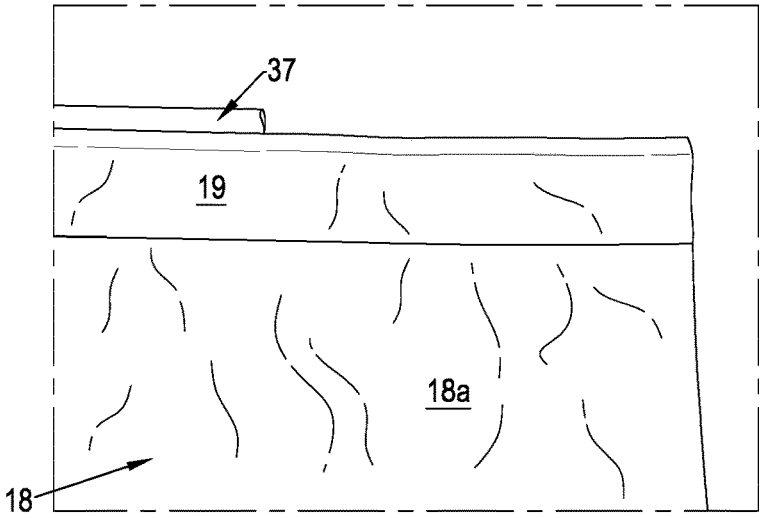
FIG. 9 is a top view of part of the membrane sheet.

FIGS. 8 and 9 show some preferred features regarding the membrane sheet 18 with integral kader rod. Referring to FIG. 8, preferably the kader rod 37 is hollow. In preferred embodiments the kader rod 37 has a substantially circular cross-sectional shape. Preferably the membrane sheet 18 has an elongate thickened section of planar fabric 19 adjacent the kader rod 37 and arranged parallel with the kader rod 37. The thickness of the thickened section 19 is only slightly greater than that of the main section of the membrane sheet 18.

In other embodiments, instead of connecting the membrane sheet 18 to the first beam 16 via kader connection, the mechanical connection may be via other suitable means such as bolts, rivets or screws (not shown in the figures). In such an embodiment the top edge of the membrane sheet 18 to be attached to the first beam 16 is bolted, riveted or screwed onto the first beam 16 at or near its bottom side 16*c*.

Referring to FIG. 6, the membrane sheet 18 extends laterally beyond the ends 16*a*, 16*b* of the first beam 16 to form first and second extension portions 18*a*. The extension portions 18*a* overlap with adjacent extension portions 18*a* of neighbouring intermediate barrier sections, allowing the overlapping extension portions 18*a* to be secured by compression by the hinged compression plate 20. In preferred embodiments, the kader rod 37 extends only along the portion of the top edge of the membrane sheet 18 that is received by the elongate slot 38 (i.e. the kader rod 37 does not extend along the first and second extension portions 18*a*, as shown in FIGS. 8 and 9).

The skirt formed by the individual membrane sheets 18 may require a mass such as sandbags or a tube of water (not shown in the figures) to weigh down and seal the leading edge to ensure the floodwater does not pass under the skirt. Preferably this may be provided by a series of metal weights, such as lead weights (not shown in the figures) sewn into or near the leading edge of the skirt.

Referring to FIG. 2, the first beam 16 has a sealing member 39 arranged at its bottom side 16*c* such that a seal may form between the first beam 16 and the ground when the flood barrier is erected. The sealing member 39 is preferably a neoprene gasket. The sealing member 39 is compressed vertically towards the ground by the compression device 36 and compressed perpendicularly to the plane of the panel formed by the beams 16, 17 by the retaining plate 20, enhancing the seal.

Figure 10:
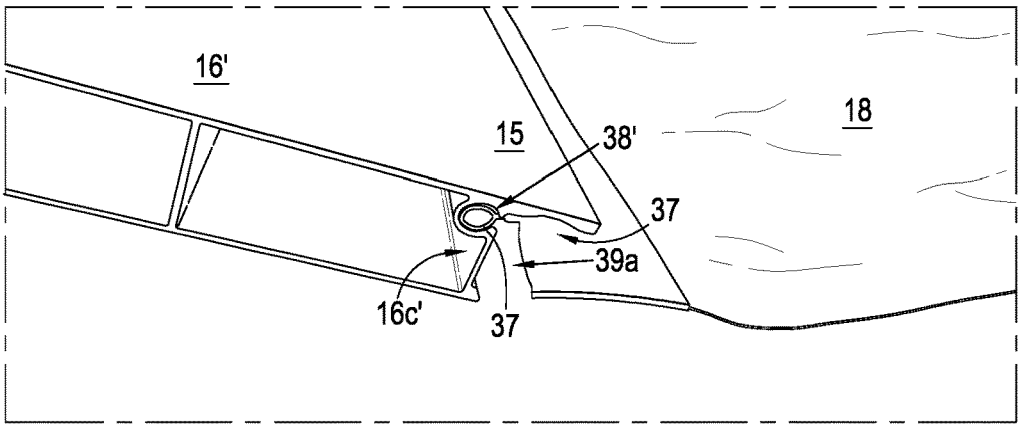
FIG. 10 is a perspective view of the first beam of another embodiment, showing the membrane sheet attached to the beam.

Another embodiment of the kader connection is shown in FIG. 10. As in the FIG. 7 embodiment, the membrane sheet 18 has a longitudinal expanded tubular edge in the form of a kader rod 37 arranged along the top edge of the membrane sheet 18. The first beam 16' has an elongate slot 38' disposed near the bottom side 16*c*', arranged so that the membrane sheet 18 extends from the waterside of the first beam 16' when attached to the first beam. The elongate slot 38' is a substantially circular channel with an opening at the waterside of the first beam 16'. Once the kader rod 37 has been inserted in the elongate slot 38' via sliding therein, the membrane sheet 18 extends over the waterside of the sealing member 39' which is received in an elongate recess 39*a* in the bottom side 16*c*' of the first beam 16'. A portion 15 of the first beam 16' projects over the edge of the membrane 18 that attaches to the first beam 16'. In use, the skirt formed by the membrane sheet 18 is pressed advantageously against the ground and against the waterside face of the sealing member 39' by floodwater.

Figure 11:
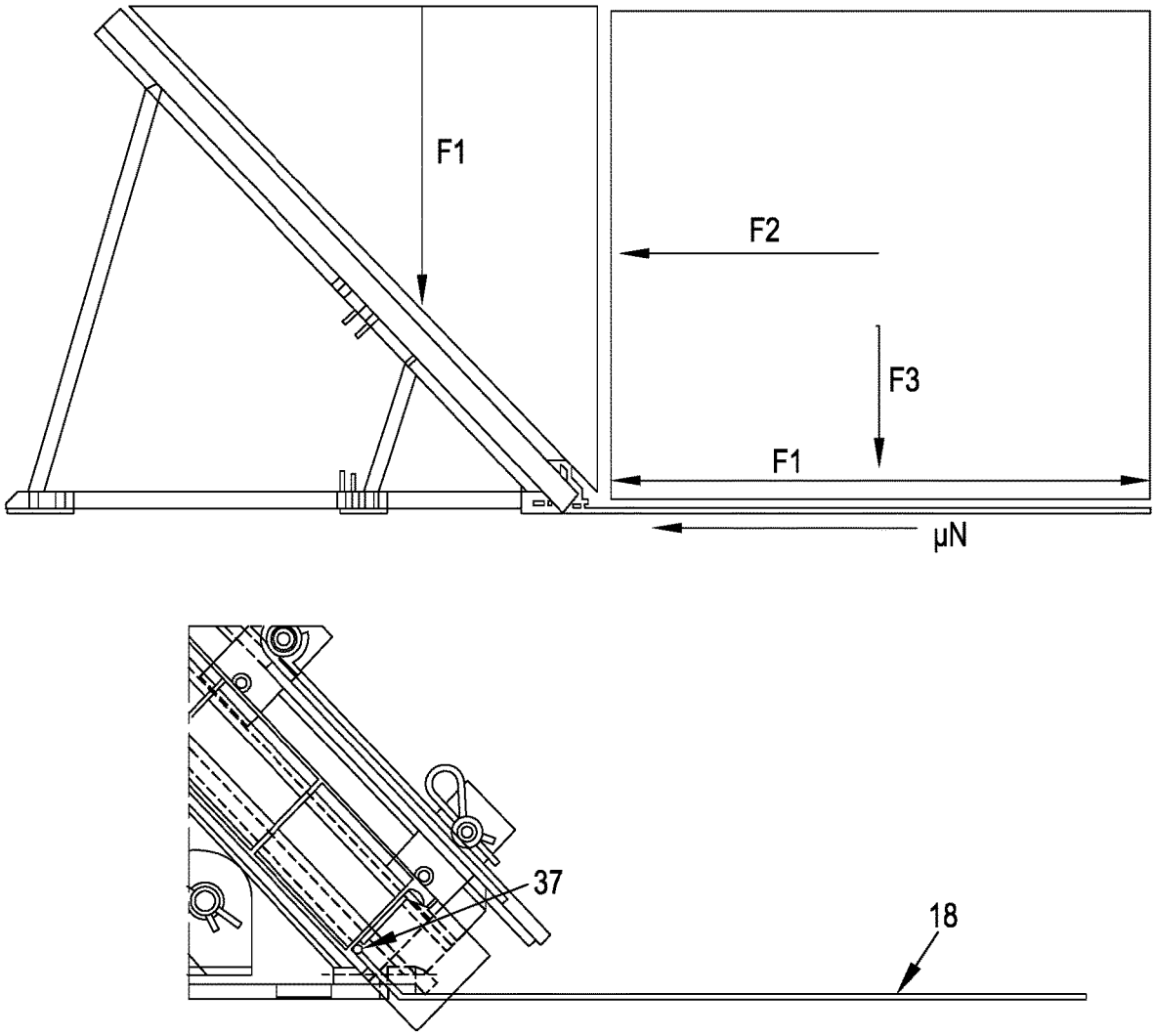
FIG. 11 is a simplified diagram showing forces acting on the flood barrier during flooding.

Referring to FIG. 11, in preferred embodiments the skirt formed by the membrane sheet 18 extends outwardly from the first beam 16 by at least a predetermined length. The predetermined skirt length L1 is selected to be long enough such that hydrostatic forces acting upon the skirt during flooding will overcome sliding forces imparted on the flood barrier by floodwaters. In FIG. 11 the symbols used are as follows:

F1=Mass of water acting directly above system
F2=Hydrostatic force acting on system
F3=Mass of water acting upon skirt
μN=Friction and force vector to overcome F1 and F2 generate a force in the horizontal direction μN. F3 acting on the skirt creates a mechanical advantage to overcome μN and reduce slippage. The mechanical advantage provided depends on the length of the skirt L1. The skirt length L1 can be predetermined depending on the height of water that the barrier is intended to withhold. For example, a flood barrier that is intended for withholding up to 2.5 m may have a skirt length of around 3 m, whereas a flood barrier that is intended for withholding a smaller height of water may have a shorter skirt length. In the close-up view of the bottom edge of the first beam in FIG. 11, the skirt 18 is shown as connected at the back of the first beam, whereas it may of course be connected at the front of the first beam (i.e. at the waterside of the first beam).

Figure 3:
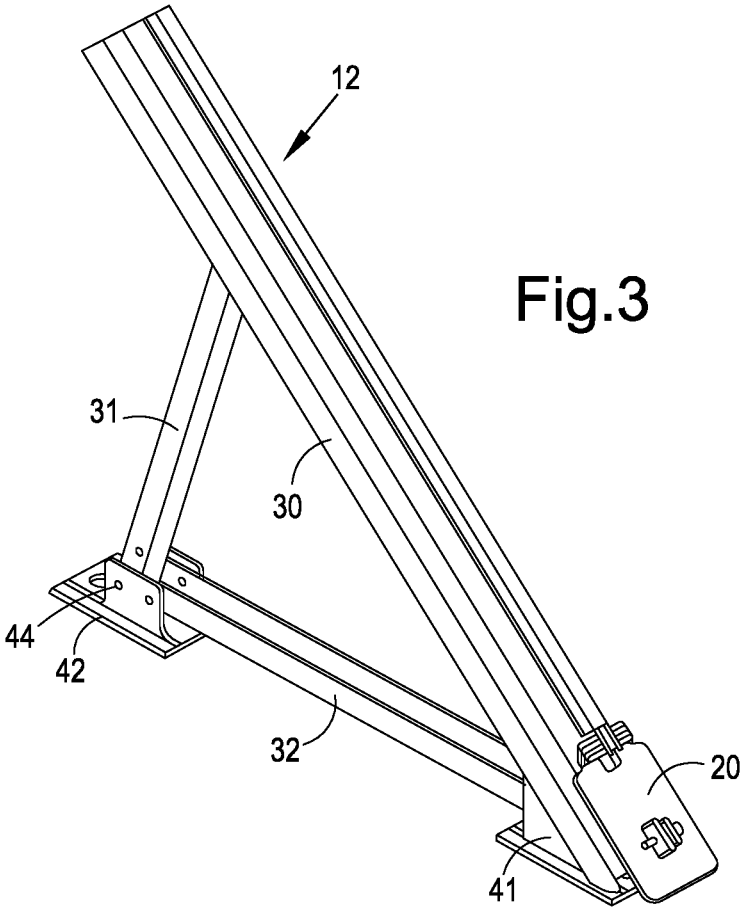
FIG. 3 is a perspective view of a support.
Figure 4:
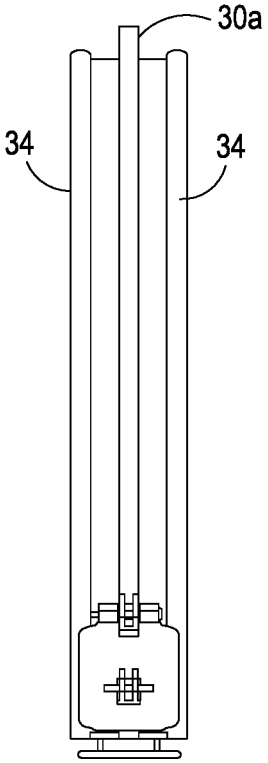
FIG. 4 is a front view of a support.
Figures 5, 5A, 5B, 5C:
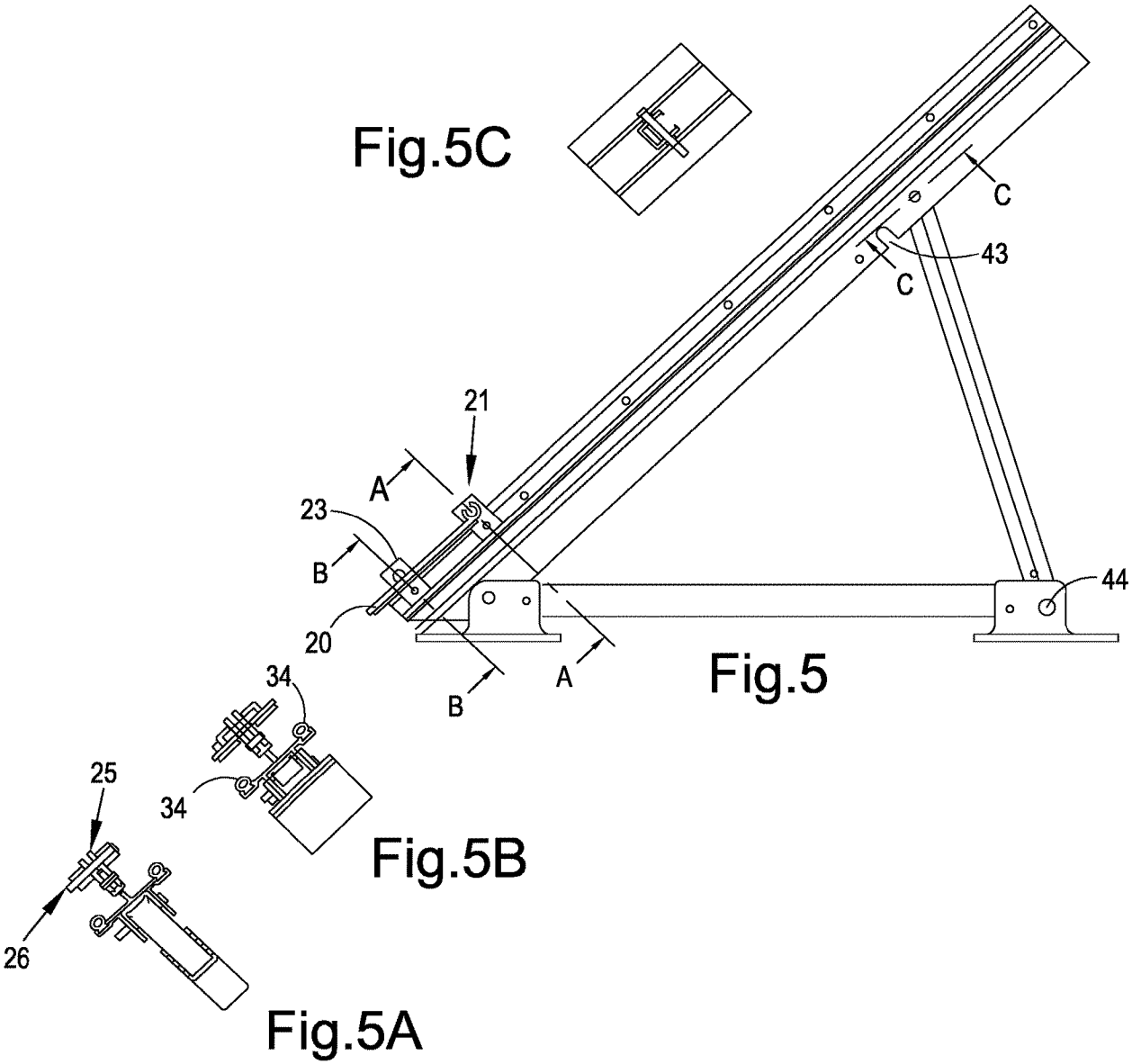
FIG. 5 is a side view of a support.
FIG. 5A is a section view along line A-A.
FIG. 5B is a section view along line B-B.
FIG. 5C is a section view along line C-C.

The supports 12 will now be further described. The supports 12 are preferably made of metal or some other suitable rigid material. The supports 12 have an open configuration, as shown in the figures, in which the first and second posts, 30, 31 and base 32 are arranged to support the beams 16, 17 and a folded configuration (not shown in the figures), in which the first and second posts, 30, 31 and base 32 are in a folded state so that the supports 12 pack to a smaller size for ease of storage or transport. Referring to FIG. 3, the base 32 is secured to front and rear feet 41, 42, one at each end of the base 32, each foot 41, 42 having a double flange for receiving the elongate base 32 therebetween. The base 32 has a U-shaped cross-section such that it can receive the second post 31 therein when in the folded configuration. The second post 31 is a box beam, which provides suitable rigidity to the support 12. The underside of the first post 30 has a U-shaped profile (i.e. a double flange profile), such that it can be received over the base 32 with the base 32 received within the U-shaped channel of the first post 30 when the support 12 is in the folded configuration. Each side flange of the U-shaped channel of the underside of the first post 30 has a recess 43 therein to receive the pivot pin 44 which passes through the rear foot 42, the rear end of the base 32 and the bottom end of the second post 31. Each side flange also has a locking hole 45 which can receive a locking pin (not shown) therethrough and through a corresponding locking hole 46 in the base 32 to lock the support 12 in the folded configuration.

Referring to FIG. 1, the compression device 36 that compresses the beams against the ground will now be described. The compression device 36 includes a sprung loaded screw pin 51 which is received in a threaded recess 52 attached to the first post 30. The screw pin 51 may therefore be threadedly adjusted to compress against the top beam in order to compress the set of beams against the ground, thus forming a watertight barrier. The threaded recess 52 can be secured at different positions along the length of the first post 30 to accommodate different numbers of beams and then to allow threaded adjustment of the screw pin 51 to provide compression to the beams.

The support 12 may be extended by connecting an additional post extension (not shown) to the first post 30 (and adding a further supporting post behind the second post 31 and an extension to the rear of the base 32) so that further beams 17 may be supported, allowing the flood defence height of the barrier to be increased.

A recurve wall (not shown) may be connected to the top panel 17 at the apex of the flood barrier to reduce wave overtopping.

In operation, in order to erect the flood barrier 10, first a plurality of supports 12 are deployed along the ground, distanced from one another. If the supports 12 are still in their folded configuration, they are unfolded into their open configuration and the posts 30, 31 and base 32 are fixed into their triangular open configuration. To install each intermediate barrier section 14, a first beam 16 is installed to rest on the bottom of the first posts 30 of a pair of neighbouring supports 12 and the retaining plates 20 are compressed against the beam ends 16*a*, 16*b* using the locking pins. The first beam 16 preferably has a membrane sheet 18 attached to it before it is installed on the supports 12, however the membrane sheet 18 may be attached to the first beam 16 after the first beam 16 has been installed to rest on the supports 12. Further beams 17 are stacked one by one above the first beam to create a continuous panel up to the required flood defence height. The compression devices 36 at each end of the intermediate barrier section 14 are actuated to compress the beams 16, 17 against the ground. The process of installing the intermediate barrier section is repeated for each space between neighbouring pairs of supports 12.

The invention claimed is:

1. A flood barrier to protect an area of land from floodwaters, the flood barrier having a waterside to be placed adjacent a body of water and a protected side opposing the waterside, the flood barrier comprising a plurality of supports spaced apart from one another;

at least one intermediate barrier section arrangeable to be supported to extend between a pair of neighbouring supports, the intermediate barrier section comprising at least a first beam and at least a second beam, each beam being installable on said neighbouring supports such that it is supported to rest on and to extend between the corresponding pair of neighbouring supports, the first beam being the beam which is closest to the ground when the barrier is erected, the first and each further beam being stacked one above the other when assembled, to form a continuous barrier surface, each intermediate barrier section further comprising a water impermeable membrane sheet attachable to said first beam via a mechanical connection to form a skirt extending from said first beam, outwardly from the waterside of the flood barrier, wherein said first beam has first and second ends and top and bottom elongate sides and wherein each support in each pair of neighbouring supports includes a retaining plate hingedly connected thereto for fastening an end of said corresponding first beam to the support, each retaining plate having a fastening configuration in which said end of the first beam is compressed between the retaining plate and the corresponding support and a release configuration in which the first beam may be inserted/withdrawn from between the retaining plate and the corresponding support, the flood barrier further including a compression device for compressing said beams against the ground in the direction of the plane of the beams when assembled, and wherein the mechanical connection of the membrane to the first beam comprises an elongate slot disposed at the bottom side of the first beam and an expanded tubular edge arranged longitudinally along the top edge of the membrane sheet, the elongate slot and expanded tubular edge being arranged such that the expanded tubular edge is receivable in the elongate slot.

2. A flood barrier according to claim 1, wherein the mechanical connection of the membrane to the first beam is a non-compressing connection.

3. A flood barrier according to claim 1, wherein each retaining plate includes compressible securing means for compressibly securing the end of a beam to the corresponding support.

4. A flood barrier according to claim 3, wherein said compressible securing means is a locking pin.

5. A flood barrier according to claim 1, wherein the mechanical connection of the membrane to the first beam is via kader connection.

6. A flood barrier according to claim 1, wherein each support comprises a first post and an elongate base, wherein the first post can be fixed at an incline relative to the base and wherein the at least one beam rests against the first post when assembled.

7. A flood barrier according to claim 1, wherein each support further comprises a second post which can be fixed to the first post and the base.

8. A flood barrier according to claim 7, wherein the second post of each support is four sided hollow tubular post.

9. A flood barrier according to claim 7, wherein each support has an open configuration, in which the first and second posts and the base are arranged to support said at least one beam, and a folded configuration, in which the first and second posts and the base are in a folded state relative to one another for ease of storage or transportation.

10. A flood barrier according to claim 1, wherein each membrane sheet, when attached, extends laterally beyond each end of the first beam to which it is attached to form first and second extension portions, whereby each extension portion can be retained between the corresponding retaining plate and support adjacent said extension portion.

11. A flood barrier according to claim 10, wherein the extension portions of each membrane extend such that each can overlap the extension portion of any neighbouring membrane, the overlapping extension portions being retained between the corresponding retaining plate and support adjacent said overlapping extension portions.

12. A flood barrier according to claim 1, wherein the intermediate barrier section comprises at least a second beam arrangeable such that it is supported to extend between the corresponding pair of neighbouring supports, the first and each further beam being stacked one above the other when assembled, to form a continuous barrier surface.

13. A flood barrier according to claim 12, wherein the first beam to which the membrane sheet is attached is the beam which is closest to the ground when the flood barrier is erected.

14. A flood barrier according to claim 12, wherein the beams in each intermediate barrier section are configured to interlock with one another when assembled.

15. A flood barrier according to claim 1, wherein the first beam of each intermediate section has a sealing member disposed on the elongate side of the beam that is to be arranged adjacent the ground such that a seal may form between the beam and the ground when the flood barrier is erected.

16. A flood barrier according to claim 1, wherein the flood barrier comprises a plurality of said intermediate barrier sections, the intermediate barrier sections being arrangeable side by side in a row such that each is supported to extend between a pair of neighbouring supports of said plurality of neighbouring supports, the supports and intermediate barrier sections forming a continuous barrier surface.

17. A flood barrier according to claim 1, wherein the skirt formed by the membrane extends outwardly from said first beam by at least a predetermined length that is sufficient such that hydrostatic forces acting upon the skirt will overcome sliding forces imparted on the flood barrier by floodwaters.

18. A kit for assembly into a flood barrier according to claim 1, wherein the kit comprises the parts for the flood barrier according to claim 1.

* * * * *